US009228384B2

(12) United States Patent
Bonomie et al.

(10) Patent No.: US 9,228,384 B2
(45) Date of Patent: Jan. 5, 2016

(54) HINGE MOUNTED SWITCH CONTROL DEVICE

(71) Applicant: Sub-Zero, Inc., Madison, WI (US)

(72) Inventors: Arturo J. Bonomie, Verona, WI (US); Daniel Mark Graham, Ashville, NY (US); Mark J. Blahnik, Sun Prairie, WI (US); Sean Petersen, Evansville, WI (US)

(73) Assignee: Sub-Zero, Inc., Madison, WI (US)

( * ) Notice: Subject to any disclaimer, the term of this patent is extended or adjusted under 35 U.S.C. 154(b) by 0 days.

(21) Appl. No.: 14/056,473

(22) Filed: Oct. 17, 2013

(65) Prior Publication Data

US 2014/0042885 A1 Feb. 13, 2014

Related U.S. Application Data

(63) Continuation of application No. 13/403,611, filed on Feb. 23, 2012, now Pat. No. 8,572,808.

(51) Int. Cl.

| | |
|---|---|
| ***F25D 23/00*** | (2006.01) |
| ***E05D 3/14*** | (2006.01) |
| ***E05F 3/20*** | (2006.01) |
| ***F25D 23/02*** | (2006.01) |

(Continued)

(52) U.S. Cl.

CPC .. *E05D 3/14* (2013.01); *E05D 7/00* (2013.01); *E05F 3/20* (2013.01); *E05F 3/227* (2013.01); *F25D 23/02* (2013.01); *F25D 23/028* (2013.01); *H01H 3/162* (2013.01); *H01H 9/00* (2013.01); *H01H 21/02* (2013.01); *E05D 11/08* (2013.01); *F25D 2323/024* (2013.01); *Y10T 16/2771* (2015.01); *Y10T 16/304* (2015.01); *Y10T 16/522* (2015.01); *Y10T 16/5383* (2015.01); *Y10T 16/5385* (2015.01); *Y10T 16/5387* (2015.01); *Y10T 16/53864* (2015.01); *Y10T 16/547* (2015.01); *Y10T 16/5476* (2015.01); *Y10T 16/551* (2015.01); *Y10T 16/61* (2015.01)

(58) Field of Classification Search

CPC ..... H01H 9/226; H01H 21/02; H01H 3/162; H01H 9/00; H01H 13/183; H01H 13/186; E05F 3/20; F25D 2700/02; F25D 2323/024; F25D 23/02; F25D 29/005

See application file for complete search history.

(56) References Cited

U.S. PATENT DOCUMENTS

| | | | |
|---|---|---|---|
| 1,496,965 | A | 6/1924 | Aldeen |
| 2,960,718 | A | 11/1960 | Lasier |

(Continued)

FOREIGN PATENT DOCUMENTS

| | | |
|---|---|---|
| DE | 3028266 | 2/1982 |
| EP | 565900 | 10/1993 |
| EP | 2131124 | 12/2009 |

OTHER PUBLICATIONS

Notice of Allowance for U.S. Appl. No. 14/060,773, mailed on May 29, 2014.

*Primary Examiner* — Daniel Rohrhoff
(74) *Attorney, Agent, or Firm* — Bell & Manning, LLC

(57) ABSTRACT

A switching system including a switch activation pin, a switch, and a switch connector is provided. The switch activation pin mounts to an arm that pivotally mounts a door to a body of a device. The switch activation pin moves with the arm when the door is opened or closed. The switch mounts to the device to control a component of the device. The switch connector mounts to the device to activate the switch based on a position of the switch activation pin.

20 Claims, 19 Drawing Sheets

(51) Int. Cl.

| | |
|---|---|
| ***H01H 9/00*** | (2006.01) |
| ***E05D 7/00*** | (2006.01) |
| ***H01H 21/02*** | (2006.01) |
| ***H01H 3/16*** | (2006.01) |
| ***E05F 3/22*** | (2006.01) |
| *E05D 11/08* | (2006.01) |

(56) References Cited

U.S. PATENT DOCUMENTS

| | | | | | |
|---|---|---|---|---|---|
| 3,259,936 | A | | 7/1966 | Sheridan | |
| 3,457,584 | A | | 7/1969 | Phelps | |
| 3,484,572 | A | * | 12/1969 | Froyd | 200/332 |
| 3,628,217 | A | | 12/1971 | Schaber et al. | |
| 3,881,077 | A | * | 4/1975 | Piber | 200/61.69 |
| 3,911,526 | A | | 10/1975 | Christy et al. | |
| 3,980,331 | A | | 9/1976 | Kennedy et al. | |
| 4,102,005 | A | | 7/1978 | Schnarr et al. | |
| 4,419,787 | A | | 12/1983 | Lieberman | |
| 5,027,473 | A | | 7/1991 | Hottmann | |
| 5,321,870 | A | | 6/1994 | Wada et al. | |
| 5,479,152 | A | * | 12/1995 | Walker et al. | 340/545.6 |
| 5,497,534 | A | | 3/1996 | Caruso | |
| 5,517,720 | A | | 5/1996 | Anderson et al. | |
| 5,522,656 | A | | 6/1996 | Jenkins | |
| 5,666,692 | A | | 9/1997 | Toledo | |
| 5,682,644 | A | | 11/1997 | Bohacik et al. | |
| 5,847,343 | A | * | 12/1998 | Kim | 200/61.76 |
| 5,896,619 | A | | 4/1999 | Koopman | |
| 5,931,554 | A | | 8/1999 | Koopman | |
| 6,150,622 | A | * | 11/2000 | Malnati | 200/61.62 |
| 6,230,364 | B1 | | 5/2001 | Cheal | |
| 6,367,123 | B1 | | 4/2002 | Cheal et al. | |
| 6,397,434 | B1 | | 6/2002 | Cheal et al. | |
| 6,684,453 | B2 | | 2/2004 | Wang | |
| 6,938,302 | B2 | | 9/2005 | Lin | |
| 7,192,105 | B2 | | 3/2007 | Jung | |
| 7,240,397 | B2 | | 7/2007 | Han | |
| 7,329,820 | B2 | * | 2/2008 | Yamamoto | 200/61.62 |
| 7,543,356 | B2 | | 6/2009 | Zetti | |
| 7,721,386 | B2 | | 5/2010 | McKinney et al. | |
| 7,735,943 | B2 | | 6/2010 | Hottmann | |
| 7,748,080 | B2 | | 7/2010 | Hottmann | |
| 7,810,213 | B2 | | 10/2010 | Brustle | |
| 7,987,558 | B2 | | 8/2011 | Beckmann et al. | |
| 8,225,459 | B2 | | 7/2012 | Waltemate et al. | |
| 8,296,906 | B2 | | 10/2012 | Wisniewski | |
| 2001/0039762 | A1 | | 11/2001 | Giovannetti | |
| 2005/0045457 | A1 | * | 3/2005 | Park | 200/61.7 |
| 2005/0138948 | A1 | * | 6/2005 | Lee | 62/331 |
| 2007/0103887 | A1 | * | 5/2007 | Bleier et al. | 362/92 |
| 2007/0223210 | A1 | * | 9/2007 | Schubert | 362/94 |
| 2007/0278081 | A1 | * | 12/2007 | Thomas et al. | 200/510 |
| 2011/0089801 | A1 | | 4/2011 | Bonomie et al. | |
| 2013/0199904 | A1 | * | 8/2013 | Huget et al. | 200/61.7 |
| 2014/0284195 | A1 | * | 9/2014 | Fujita et al. | 200/536 |

* cited by examiner

HINGE MOUNTED SWITCH CONTROL DEVICE

CROSS-REFERENCE TO RELATED APPLICATIONS

The present application is a continuation of U.S. patent application Ser. No. 13/403,611 that was filed Feb. 23, 2012, the entire contents of which are hereby incorporated by reference.

BACKGROUND

Doors of all kinds are mounted to hinges for opening and closing of the doors. Hinges may include a biasing mechanism, such as a spring, to provide a bias force tending to close the door to assist users in closing the door and to prevent the door from remaining in an open position. For example, such self-closing mechanisms are useful in refrigerator doors to make sure the door is not inadvertently left open. Further, hinges may include stops positioned to prevent the door from opening beyond a predefined angle to avoid damage to surrounding objects as well as to the door itself. Still further, devices have been provided that determine when the door is opened and/or closed to control a light that is triggered on when the door is opened.

SUMMARY

In an example embodiment, a switching system is provided. The switching system includes, but is not limited to, a switch activation pin, a switch, and a switch connector. The switch activation pin mounts to an arm that pivotally mounts a door to a body of a device. The switch activation pin moves with the arm when the door is opened or closed. The switch mounts to the device to control a component of the device. The switch connector mounts to the device to activate the switch based on a position of the switch activation pin.

In an example embodiment, a hinge is provided. The hinge includes, but is not limited to, a device bracket, a door bracket, an arm, a switch activation pin, a switch, and a switch connector. The device bracket mounts to a device surface of a device. The door bracket mounts to a door surface of a door of the device. The arm is mounted for rotation about a first pin and about a second pin. The first pin is mounted to the device bracket, and the second pin is mounted to the door bracket. The switch activation pin mounts to the arm to move with the arm when the door is opened or closed. The switch mounts to the device to control a component of the device. The switch connector mounts to the device to activate the switch based on a position of the switch activation pin.

In an example embodiment, a refrigerator is provided. The refrigerator includes, but is not limited to, a body, a door, and a hinge pivotally mounting the door to the body. The hinge includes, but is not limited to, a refrigerator bracket, a door bracket, an arm, a switch activation pin, a switch, and a switch connector. The refrigerator bracket mounts to a surface of the refrigerator. The door bracket mounts to a door surface of the door of the refrigerator. The arm is mounted for rotation about a first pin and about a second pin. The first pin is mounted to the refrigerator bracket, and the second pin is mounted to the door bracket. The switch activation pin mounts to the arm to move with the arm when the door is opened or closed. The switch mounts to the body to control a component of the refrigerator. The switch connector mounts to the body to activate the switch based on a position of the switch activation pin.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
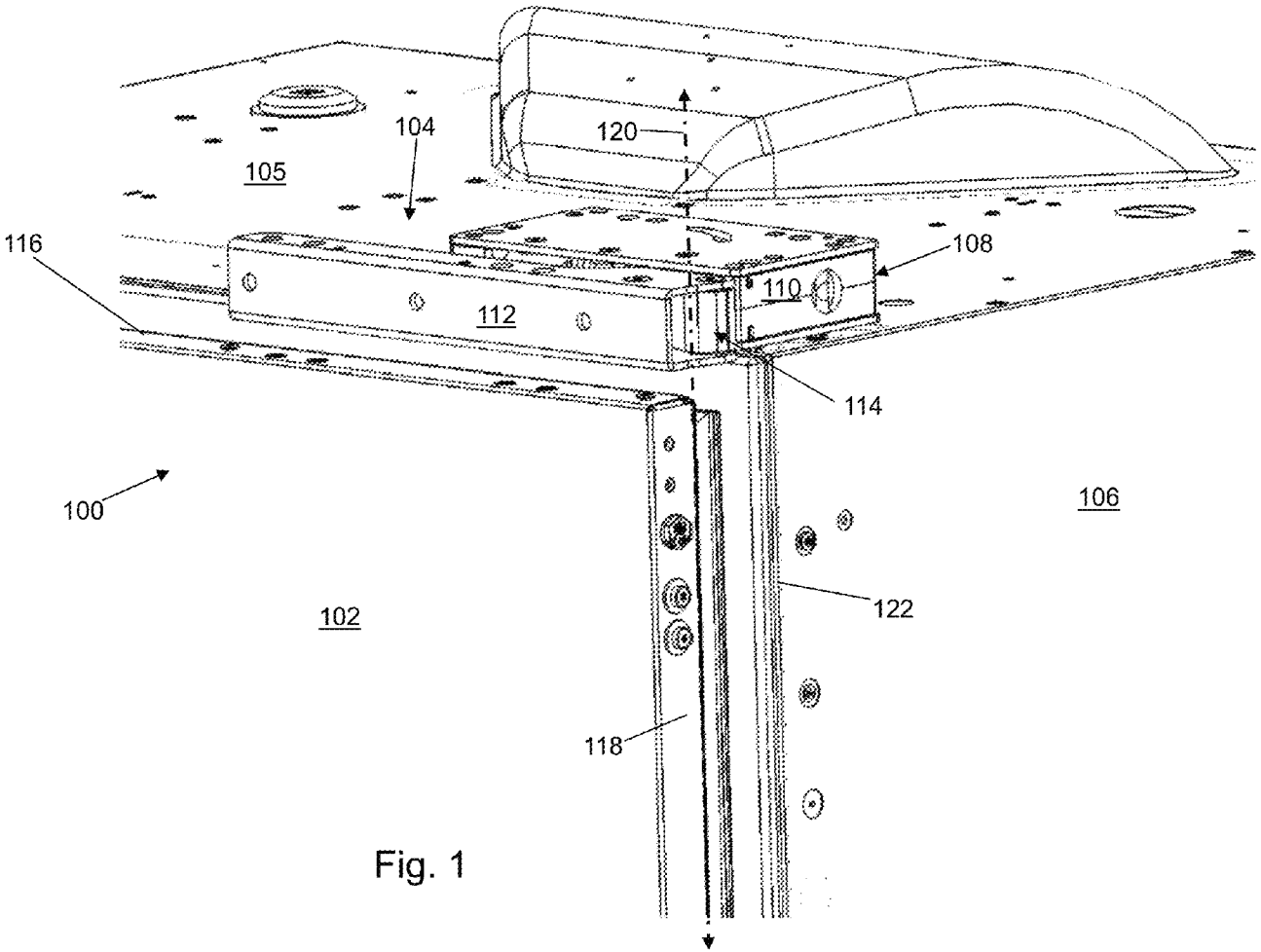
FIG. 1 depicts a perspective view of a top portion of a device including a hinge in accordance with an illustrative embodiment.

With reference to FIG. 1, a device 100 is shown in accordance with an illustrative embodiment. Device 100 may include a door 102, a top wall 104, a first side wall 106, a second side wall (not shown), a bottom wall (not shown), a back wall (not shown), and a hinge 108. Thus, device 100 defines an enclosed space using five walls and a door. However, device 100 need not define an enclosed space and may include a fewer or a greater number of walls. Device 100 further may include a plurality of doors. Though shown in the illustrative embodiment as forming a generally rectangular enclosure, device 100 may form any shaped enclosure including other polygons as well as circular or elliptical enclosures. As a result, door 102 and the walls forming device 100 may have any shape including other polygons as well as circular or elliptical shapes. Merely for illustration, device 100 is a refrigerator and/or a freezer and door 102 provides access to a refrigerated space.

Hinge 108 mounts door 102 for rotational movement of the door relative to a wall of device 100. For example, hinge 108 mounts door 102 for rotational movement relative to an edge of a wall of device 100. The components of hinge 108 described herein may be formed of one or more metals or plastics having a sufficient strength and rigidity for the described application possibly dependent on device 100 and a size and weight of door 102. Device 100 may include a plurality of hinges used to mount door 102 to a wall of device 100. The plurality of hinges may or may not comprise the same design.

Figure 2:
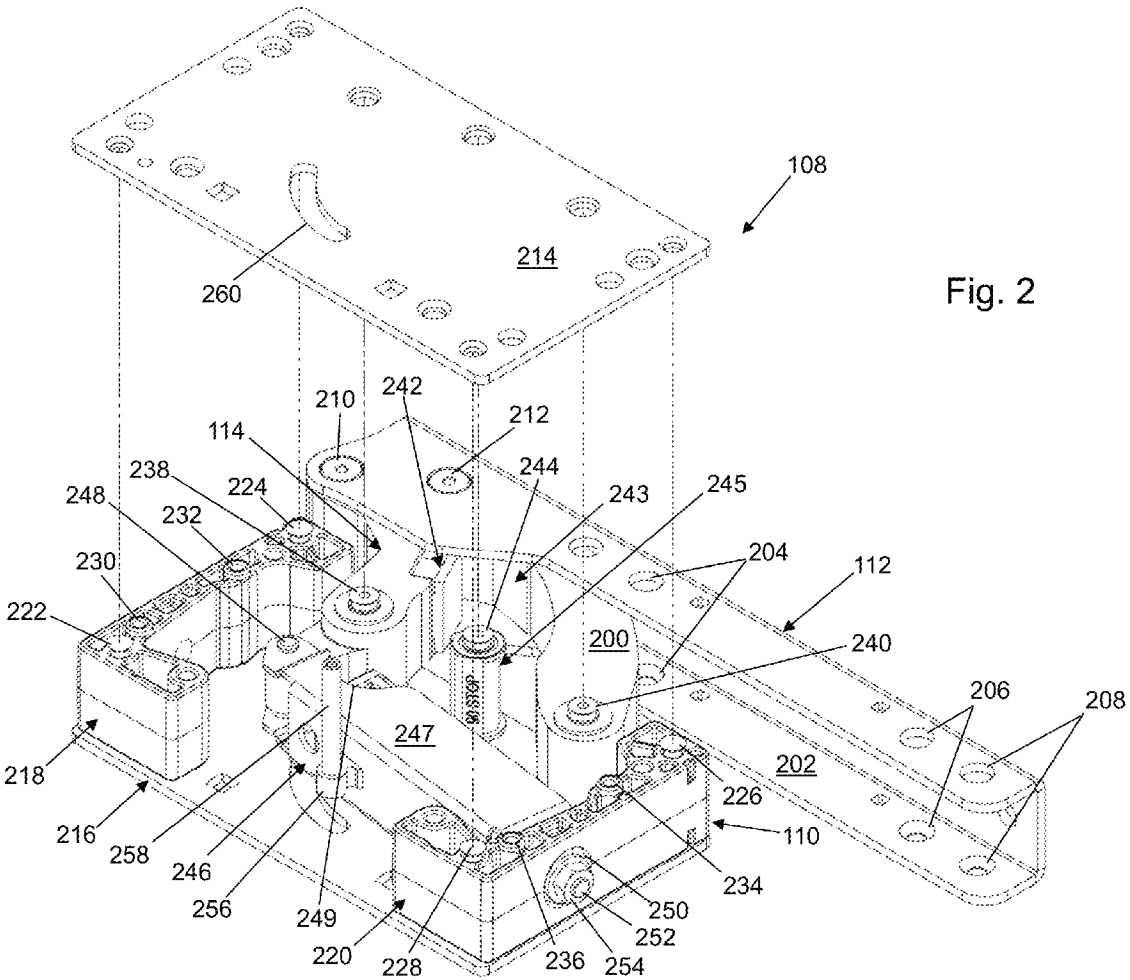
FIG. 2 depicts a perspective view of the hinge of FIG. 1 in accordance with an illustrative embodiment.

Hinge 108 includes a device bracket 110, a door bracket 112, a first arm 114, and a second arm 200 (shown with reference to FIG. 2). First arm 114 is mounted to device bracket 110 and to door bracket 112. Second arm 200 is mounted to device bracket 110 and to door bracket 112. Device bracket 110, door bracket 112, first arm 114, and second arm 200 form a 4-bar linkage as understood by a person of skill in the art. As used in this disclosure, the term "mount" includes join, unite, connect, couple, associate, insert, hang, hold, affix, attach, fasten, bind, paste, secure, bolt, screw, rivet, solder, weld, glue, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact).

In the illustrative embodiment, device bracket 110 is mounted to an exterior surface 105 of top wall 104, and door bracket 112 is mounted to an exterior edge surface 116 of door 102. In this context, exterior and interior are relative to any space formed by a confluence of the walls of device 100 though device 100 may not form a completely enclosed space. Of course, hinge 108 may be mounted between any two adjacent surfaces of the walls of device 100. In the illustrative embodiment, first arm 114 and second arm 200 rotate in a plane parallel to at least the portion of exterior surface 105 on which device bracket 110 is mounted. First arm 114 and second arm 200 are further mounted to device bracket 110 and to door bracket 112 to provide rotation of a door rotational edge 118 of door 102 about an axis of rotation 120 that is parallel to at least a portion of door rotational edge 118 and to at least a corresponding portion of an edge 122 of first side wall 106. Door rotational edge 118 of door 102 may translate relative to the remaining walls of device 100. As a result, axis of rotation 120 also translates relative to edge 122 of first side wall 106. In the illustrative embodiment, axis of rotation 120 is perpendicular to the plane that is parallel to at least the portion of exterior surface 105 on which device bracket 110 is mounted.

With reference to FIG. 2, a perspective view of hinge 108 is shown in accordance with an illustrative embodiment. Door bracket 112 of hinge 108 may include a door bracket body 202 and a plurality of door mounting apertures. The plurality of door mounting apertures may include a first plurality of door mounting apertures through which one or more fasteners are inserted to mount door bracket 112 to exterior edge surface 116 of door 102. Illustrative fasteners include screws and rivets though other methods of mounting door bracket 112 to exterior edge surface 116 of door 102 may be used. Of course, door bracket 112 may be mounted to other surfaces of door 102. In the illustrative embodiment, the first plurality of door mounting apertures include a first aligned pair of apertures 204, a second aligned pair of apertures 206, and a third aligned pair of apertures 208. A fastener is inserted through the aligned pairs of apertures 204, 206, 208 and into exterior edge surface 116 of door 102 to mount door bracket 112 to door 102.

First arm 114 rotatably mounts to door bracket 112 using a first arm door pin 210. First arm door pin 210 is inserted through a fourth aligned pair of apertures 300 (shown with reference to FIG. 3) formed in door bracket 112 and through a first arm aperture 304 (shown with reference to FIG. 3) in first arm 114. Second arm 200 rotatably mounts to door bracket 112 using a second arm door pin 212. Second arm door pin 212 is inserted through a fifth aligned pair of apertures 302 (shown with reference to FIG. 3) formed in door bracket 112 and through a third arm aperture 308 (shown with reference to FIG. 3) in second arm 200.

Device bracket 110 of hinge 108 may include a top device bracket plate 214, a bottom device bracket plate 216, a first device spacer block 218, and a second device spacer block 220. In an illustrative embodiment, top device bracket plate 214 and bottom device bracket plate 216 have identical shapes and apertures formed therein, which have the same location, shapes, and sizes to reduce manufacturing costs. Use of directional terms, such as top, bottom, right, left, front, back, etc. are merely intended to facilitate reference to the various surfaces of the described structures relative to the orientations shown in the drawings and are not intended to be limiting in any manner. For example, if hinge 108 is mounted at a bottom of door 102, top device bracket plate 214 will be positioned below bottom device bracket plate 216.

In an illustrative embodiment, first device spacer block 218 and second device spacer block 220 have identical shapes and apertures formed therein, which have the same location, shapes, and sizes to reduce manufacturing costs. A first rivet 222, a second rivet 224, a third rivet 226, a fourth rivet 228, a first mounting pin 230, a second mounting pin 232, a third mounting pin 234, and a fourth mounting pin 236 are inserted in apertures (shown with reference to FIG. 3, but not labeled due to space limitations) of top device bracket plate 214, of bottom device bracket plate 216, of first device spacer block 218, and of second device spacer block 220 to mount top device bracket plate 214, bottom device bracket plate 216, first device spacer block 218, and second device spacer block 220 together to form a housing for other components of hinge 108. The housing may completely or only partially cover the other components of hinge 108.

First arm 114 rotatably mounts to top device bracket plate 214 and to bottom device bracket plate 216 using a first arm device pin 238. First arm device pin 238 is inserted through a first arm plate aperture 344 (shown with reference to FIG. 3) formed in top device bracket plate 214, through an aperture (not shown) formed in bottom device bracket plate 216, and through a second arm aperture 306 (shown with reference to FIG. 3) formed in first arm 114. Second arm 200 rotatably mounts to top device bracket plate 214 and to bottom device bracket plate 216 using a second arm device pin 240. Second arm device pin 240 is inserted through a second arm plate aperture 348 (shown with reference to FIG. 3) formed in top device bracket plate 214, through an aperture (not shown) formed in bottom device bracket plate 216, and through a fourth arm aperture 310 (shown with reference to FIG. 3) formed in second arm 200.

In the illustrative embodiment of FIG. 2, a first door stop 242 is mounted to first arm 114, and a second door stop 243 is mounted to second arm 200. A door stop pin 244 rotatably mounts between top device bracket plate 214 and bottom device bracket plate 216. A door stop pin housing 245 surrounds door stop pin 244. Door stop pin 244 is inserted through a stop pin plate aperture 346 (shown with reference to FIG. 3) formed in top device bracket plate 214, through an aperture (not shown) formed in bottom device bracket plate 216, and through a stop pin aperture 350 (shown with reference to FIG. 3) formed in door stop pin housing 245.

First door stop 242 is positioned on first arm 114 to contact door stop pin housing 245 when door 102 is opened to a predefined angle. First door stop 242 is padded to absorb the force when first arm 114 contacts door stop pin housing 245. Second door stop 243 is positioned on second arm 200 to contact first arm 114 when door 102 is opened to a second predefined angle. Second door stop 243 is padded to absorb the force when second arm 200 contacts first arm 114. In an illustrative embodiment, the predefined angle is 90 degrees and the second predefined angle is 105 degrees though other angles may be selected. The predefined angle and the second predefined angle may be approximately equal, for example, to provide additional shock absorption at the same angle if the door is opened with a large force.

Figure 3:
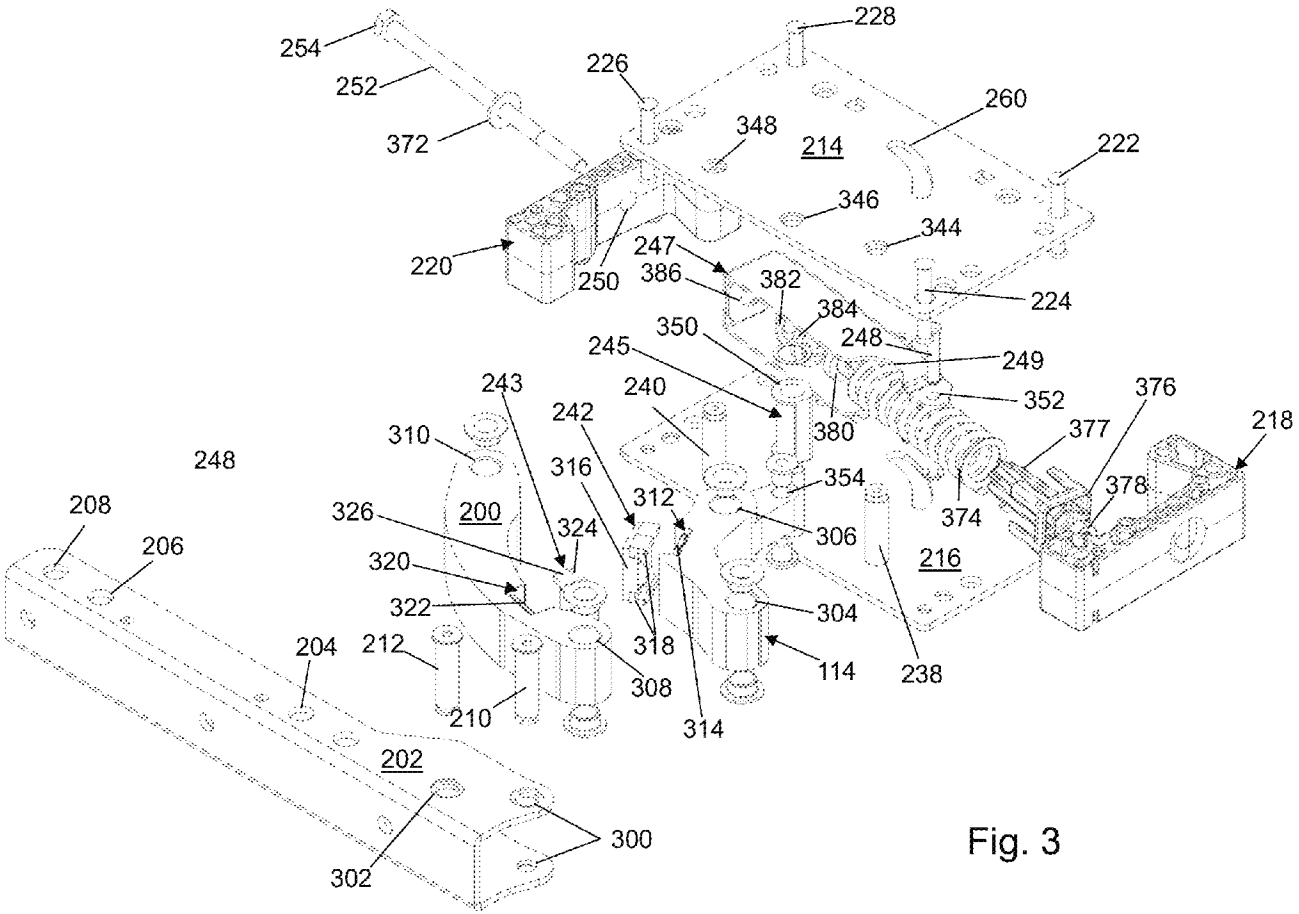
FIG. 3 depicts an exploded perspective view of the hinge of FIG. 1 in accordance with an illustrative embodiment.

With reference to FIG. 3, a first stop recess 312 is formed in first arm 114 in accordance with an illustrative embodiment. A first stop top ledge 314 and a first stop bottom ledge 1608 (shown with reference to FIGS. 16 and 17) are formed in first stop recess 312. First door stop 242 includes a first shock absorber 316 and first stop snaps 318. First door stop 242 is mounted to first stop recess 312 by pressing first stop snaps 318 over first stop top ledge 314 and first stop bottom ledge 1608. First shock absorber 316 is positioned outward to form a padded exterior surface on first arm 114. First shock absorber 316 may be formed of a variety of materials used to absorb mechanical energy such as various plastics, foams, elastic polymers, etc. Depending on the material used and the expected weight of door 102, first shock absorber 316 may have a variety of thicknesses. In alternative embodiments, first shock absorber 316 may be formed using other structures to absorb the mechanical energy or force transferred between first door stop 242 and door stop pin housing 245 when first door stop 242 contacts door stop pin housing 245. For example, a spring or damping mechanism may be used to absorb the energy transferred.

Similar to first stop recess 312, a second stop recess 320 is formed in second arm 200. A second stop top ledge 322 and a second stop bottom ledge (not shown) are formed in second stop recess 320. Second door stop 243 includes a second shock absorber 324 and second stop snaps 326. Second door stop 243 is mounted to second stop recess 320 by pressing second stop snaps 326 over second stop top ledge 322 and the second stop bottom ledge. Second shock absorber 324 is positioned outward to form a padded exterior surface on second arm 200. Second shock absorber 324 may be formed of a variety of materials used to absorb mechanical energy such as various plastics, foams, elastic polymers, etc. Depending on the material used and the expected weight of door 102, second shock absorber 324 may have a variety of thicknesses. In alternative embodiments, second shock absorber 324 may be formed using other structures to absorb the mechanical energy or force transferred between second door stop 243 and first arm 114 when second door stop 243 contacts first arm 114. For example, a spring or damping mechanism may be used to absorb the energy transferred.

Figure 4:
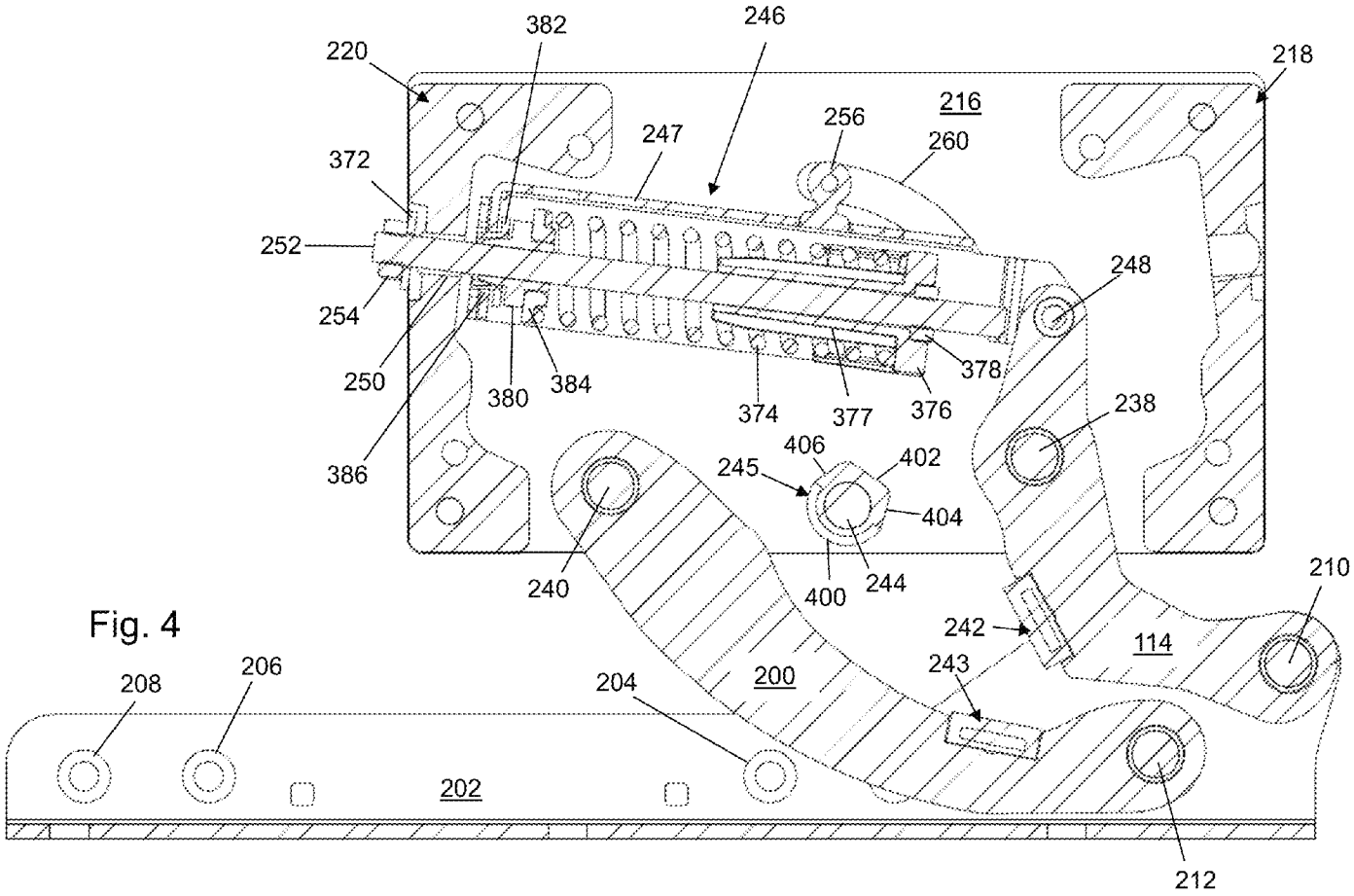
FIG. 4 depicts a top section view of the hinge of FIG. 1 in a closed position in accordance with an illustrative embodiment.

With reference to FIG. 4, door stop pin housing 245 is shown in accordance with an illustrative embodiment. Door stop pin housing 245 may include an arced surface 400, a stop surface 402, a first connecting surface 404, and a second connecting surface 406. First connecting surface 404 is formed between arced surface 400 and stop surface 402. Second connecting surface 406 is formed between arced surface 400 and stop surface 402. Arced surface 400 has a curved shape, whereas first connecting surface 404, second connecting surface 406, and stop surface 402 are flat.

With continuing reference to the illustrative embodiment of FIG. 2, hinge 108 further includes a closure device 246. Closure device 246 may include a closure device body 247, an adjustment rod 252, and an adjustment nut 254. A body arm pin 248 mounts closure device body 247 to first arm 114 so that closure device body 247 moves with first arm 114 and exerts a force on first arm 114 when door 102 is opening and/or closing. For example, body arm pin 248 is inserted through a first mounting pin aperture 352 (shown with reference to FIG. 3) formed in closure device body 247 and through a second mounting pin aperture 354 (shown with reference to FIG. 3) formed in first arm 114.

In the illustrative embodiment of FIG. 2, closure device body 247 is generally rectangular in shape and includes a body arced surface 249. Body arced surface 249 is formed in closure device body 247 to accommodate a first arm portion 700 of first arm 114 as closure device body 247 rotates with first arm 114 and approaches first arm portion 700 as shown with reference to FIG. 7. Adjustment rod 252 is inserted in an adjustment rod aperture 250 in second device spacer block 220 and is mounted within closure device body 247. Adjustment nut 254 mounts adjustment rod 252 to device bracket 110 at adjustment rod aperture 250. Adjustment nut 254 is accessible from an exterior of device bracket 110. Adjustment nut 254 and adjustment rod 252 may be integrally formed together of one piece of material. For example, adjustment nut 254 and adjustment rod 252 may form a screw with adjustment nut 254 forming the screw head. As another alternative, adjustment nut 254 may be threaded onto adjustment rod 252 or otherwise mounted to adjustment rod 252.

With reference to FIGS. 3 and 4, additional components of closure device 246 are shown in accordance with an illustrative embodiment. Closure device 246 further may include a washer 372, a spring 374, a first retainer 376, a spring guide 377, a retainer nut 378, a friction sleeve 380, a compression ring 382, and a second retainer 384. Adjustment rod 252 is mounted to adjustment nut 254. An end of adjustment rod 252 opposite adjustment nut 254 is inserted through washer 372, adjustment rod aperture 250, a body aperture 386 of closure device body 247, compression ring 382, friction sleeve 380, second retainer 384, spring 374, spring guide 377, first retainer 376, and retainer nut 378. A position of the end of adjustment rod 252 opposite adjustment nut 254 can be adjusted from exterior to second device spacer block 220 of hinge 108.

Spring 374 is mounted between first retainer 376 and second retainer 384. In an illustrative embodiment, spring 374 is a compression spring. First retainer 376 includes retainer nut 378 and spring guide 377, which extends from first retainer 376 in a direction opposite retainer nut 378. First retainer 376 is mounted to adjustment rod 252 using retainer nut 378. Spring 374 encircles spring guide 377.

Friction sleeve 380 is mounted within second retainer 384 on a first side and within compression ring 382 on a second side opposite the first side. Compression ring 382 is mounted within body aperture 386 of closure device body 247. Friction sleeve 380 is configured to apply a frictional force when door 102 is opened or closed. As a result of pressing friction sleeve 380 further into compression ring 382, the frictional force can be increased when the door is opened or closed.

Figure 5:
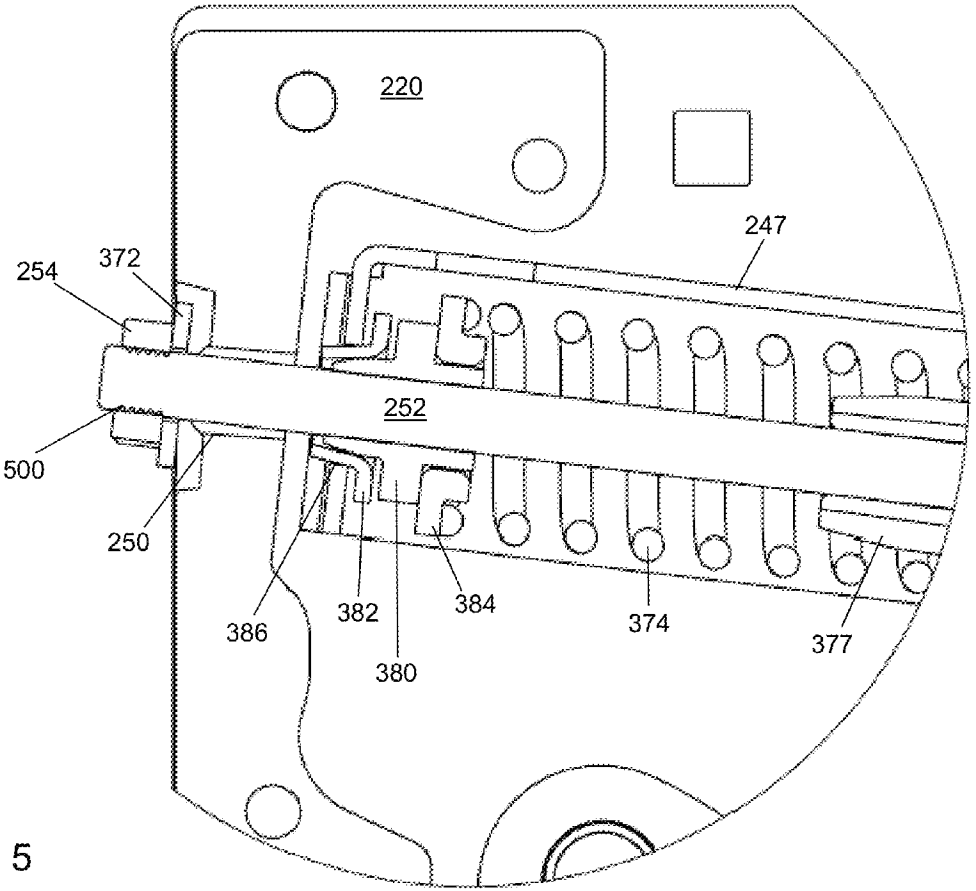
FIG. 5 depicts a zoomed view of a portion of a closing mechanism of the hinge of FIG. 1 in a closed position in accordance with a first illustrative embodiment.

With reference to the illustrative embodiment of FIG. 5, adjustment rod 252 includes a threaded surface 500 to which adjustment nut 254 is mounted. By rotating either adjustment nut 254 or adjustment rod 252, a distance between first retainer 376 and second retainer 384 (closure device body 247) can be reduced or increased. As a result, adjustment nut 254 is configured to allow adjustment of the force exerted by spring 374 on first arm 114. The stored compression force of spring 374 assists in closing door 102. The amount of the stored force can be increased by turning adjustment nut 254 in a direction that shortens the distance between first retainer 376 and second retainer 384 (closure device body 247) and can be reduced by turning adjustment nut 254 in an opposite direction that increases the distance between first retainer 376 and second retainer 384 (closure device body 247). Thus, depending on the weight and the size of door 102, the closing force, and as a result, the closing velocity of door 102, can be controlled using adjustment nut 254, which is accessible from the exterior of hinge 108. Therefore, the same hinge can be used to mount doors having different sizes and weights while maintaining a predefined velocity profile for the closing of the different types of doors.

Figure 6:
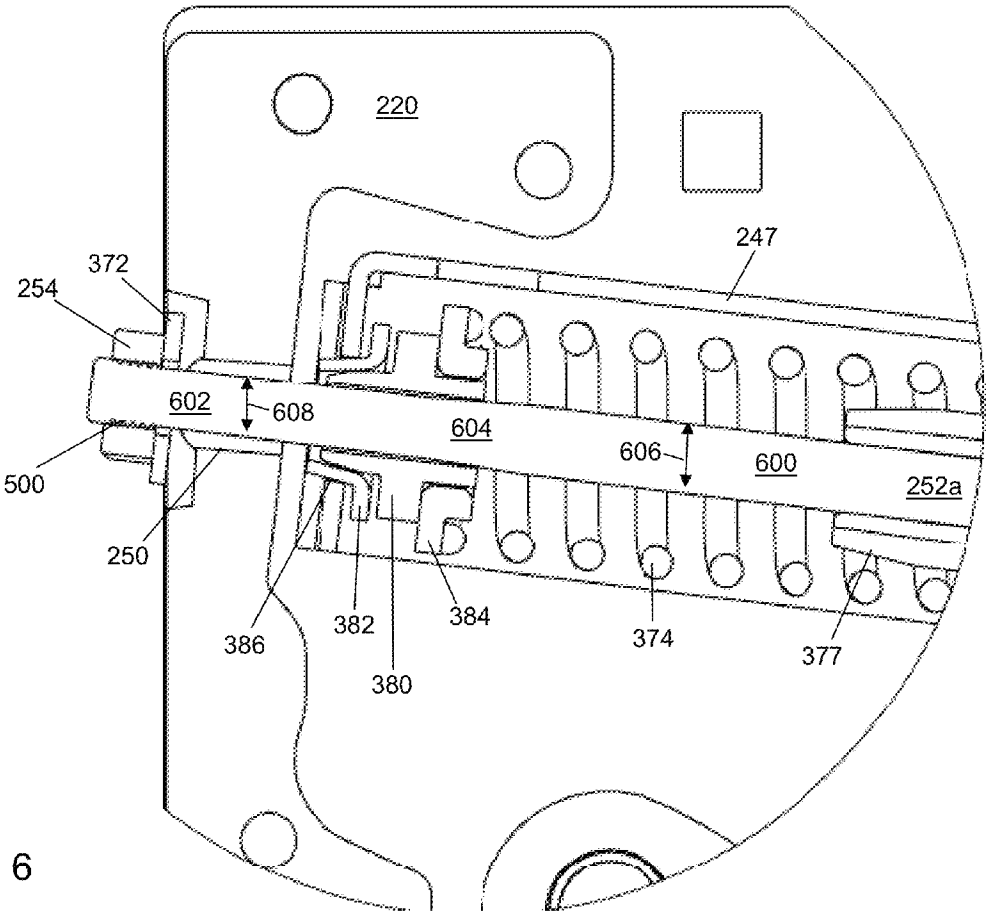
FIG. 6 depicts a zoomed view of a portion of a second closing mechanism of the hinge of FIG. 1 in a closed position in accordance with a second illustrative embodiment.

With reference to FIG. 6, a tapered adjustment rod 252*a* can be used in an alternative embodiment. Tapered adjustment rod 252*a* may include a first portion 600, a second portion 602, and a transition portion 604. First portion 600 extends through spring 374, spring guide 377, first retainer 376, and retainer nut 378 and has a first diameter 606. Second portion 602 may extend through washer 372, adjustment rod aperture 250, body aperture 386, a portion of compression ring 382, a portion of friction sleeve 380, and a portion of second retainer 384. Second portion 602 has a second diameter 608. Second diameter 608 is smaller than first diameter 606. Transition portion 604 provides a transition between first portion 600 and second portion 602, and thus, has a diameter that changes from first diameter 606 at the interface with first portion 600 to second diameter 608 at the interface with second portion 602. Of course, tapered adjustment rod 252*a* may be integrally formed as a single object having the variable diameter. Transition portion 604 may extend through a second portion of compression ring 382, a second portion of friction sleeve 380, and a second portion of second retainer 384 depending on the positioning of tapered adjustment rod 252*a* within closure device 246. The frictional force is reduced when transition portion 604 or second portion 602 is positioned within friction sleeve 380. Thus, tapered adjustment rod 252*a* provides for a further adjustment of the force on door 102 when door 102 is opened or closed.

Figure 7:
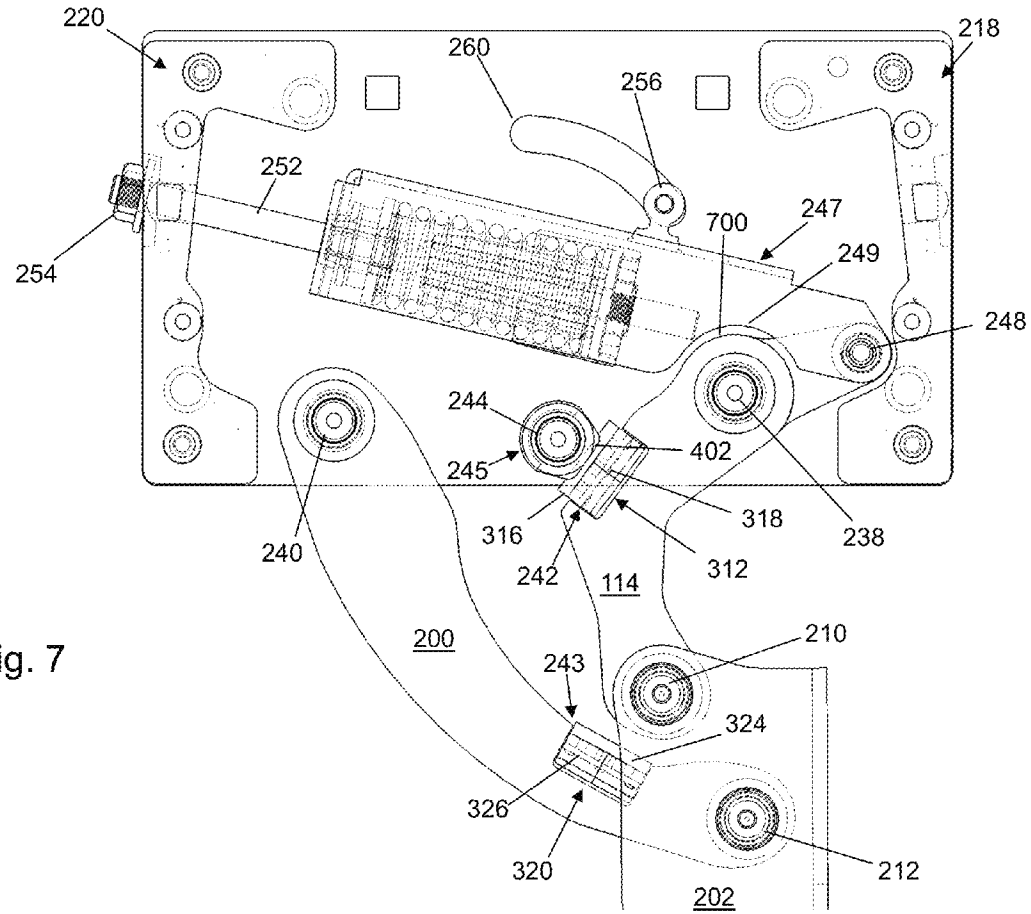
FIG. 7 depicts a top view of the hinge of FIG. 1 in a 90 degree open position in accordance with an illustrative embodiment without a top device bracket plate and showing internal parts.
Figure 8:
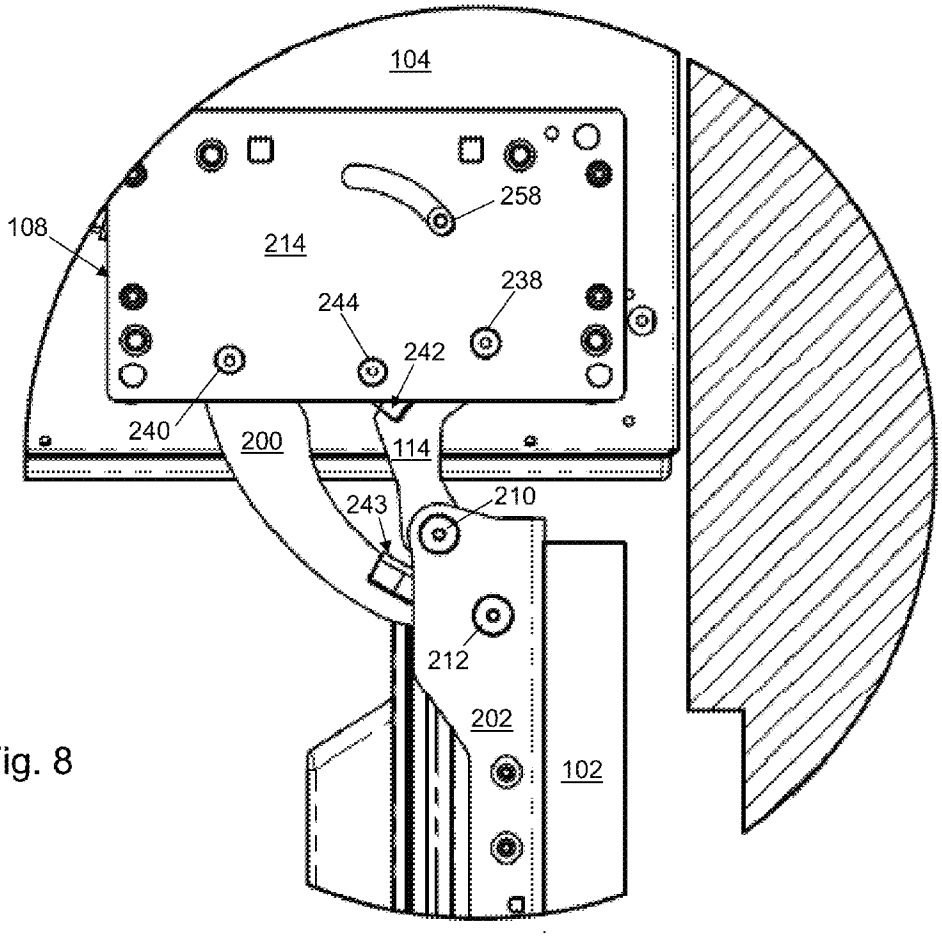
FIG. 8 depicts a top view of the hinge of FIG. 1 in a 90 degree open position relative to an edge of the device in accordance with an illustrative embodiment.

With reference to FIG. 7, a top view of hinge 108 open to a 90 degree position is shown in accordance with an illustrative embodiment. Closure device body 247 moved with first arm 114 in a direction away from adjustment nut 254 as door 102 was opened. The direction of movement of closure device body 247 corresponds to a pin travel aperture 260. Spring 374 is compressed and body arced surface 249 of closure device body 247 partially encircles first arm portion 700 of first arm 114 when hinge 108 is open to the 90 degree position. First shock absorber 316 of first door stop 242 contacts stop surface 402 of door stop pin housing 245. Of course, first door stop 242 may be positioned on first arm 114 to contact door stop pin 244 at angles greater than or less than 90 degrees. With reference to FIG. 8, a top view of hinge 108 in the 90 degree open position is shown relative to an edge of device 100 in accordance with an illustrative embodiment.

Figure 9:
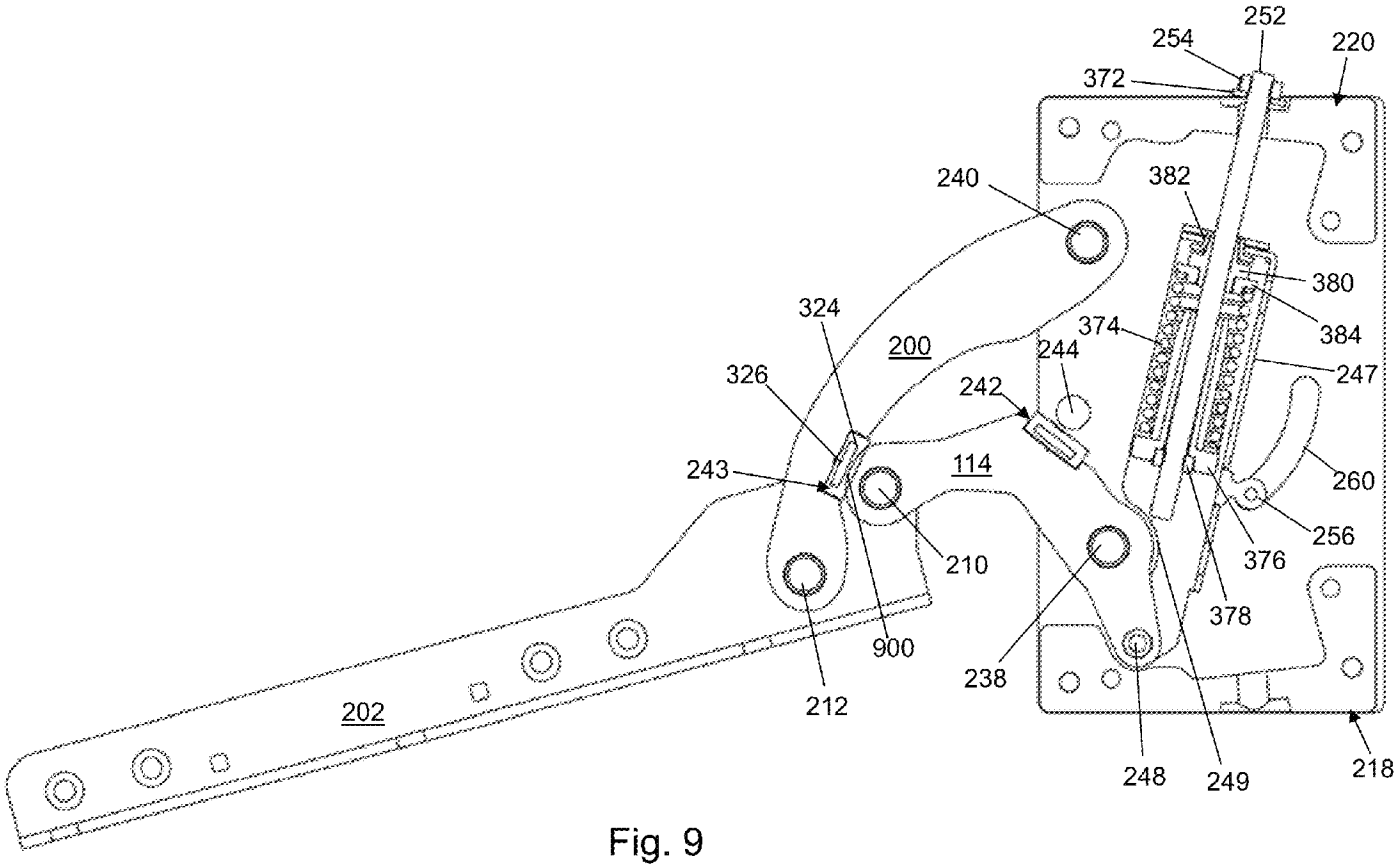
FIG. 9 depicts a top view of the hinge of FIG. 1 in a 105 degree open position in accordance with an illustrative embodiment.
Figure 10:
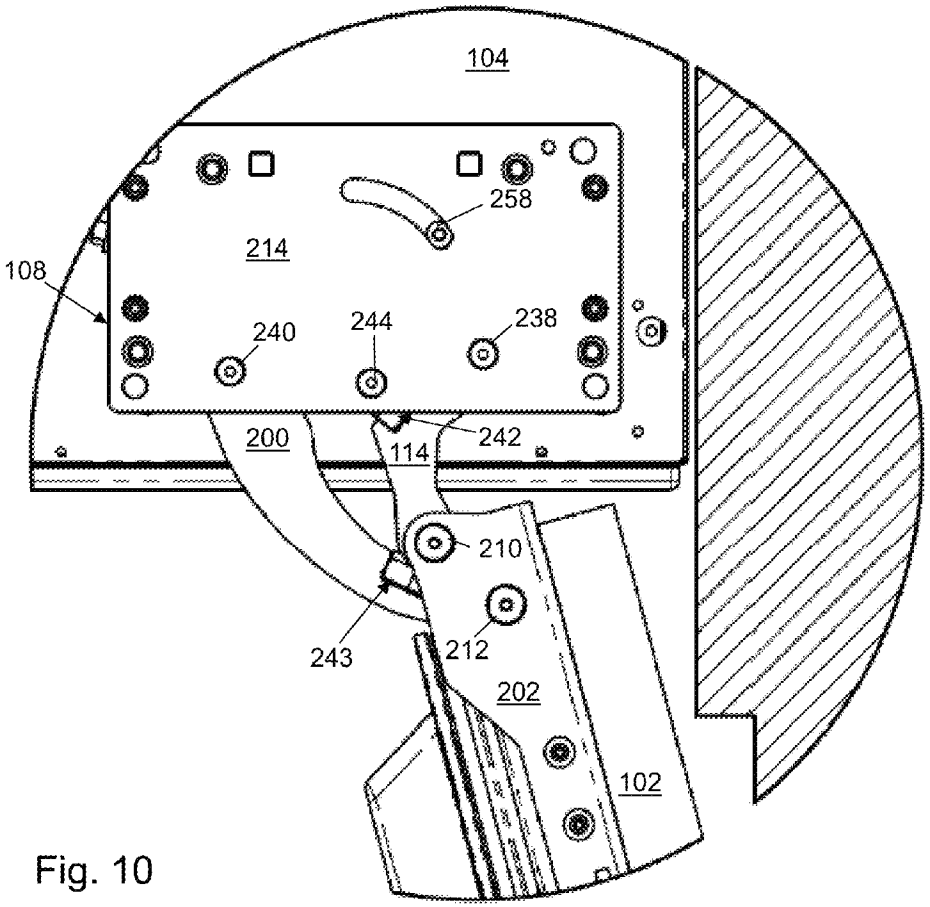
FIG. 10 depicts a top view of the hinge of FIG. 1 in a 105 degree open position relative to an edge of the device in accordance with an illustrative embodiment.

With reference to FIG. 9, a top view of hinge 108 open to a 105 degree position is shown in accordance with an illustrative embodiment. Second shock absorber 324 of second door stop 243 contacts a second arm portion 900 of first arm 114 when hinge 108 reaches the 105 degree open position. Second door stop 243 limits movement of door 102 beyond 105 degrees. With reference to FIG. 10, a top view of hinge 108 in the 105 degree open position is shown relative to the edge of device 100 in accordance with an illustrative embodiment. Of course, first door stop 242 may be positioned on first arm 114 to contact door stop pin 244 at angles greater than or less than 90 degrees. Of course, second door stop 243 may be positioned on second arm 200 to contact first arm 114 at angles greater than or less than 105 degrees including at approximately the same angle as that selected for first door stop 242. For example, first door stop 242 and second door stop 243 may be positioned for contact at approximately the same angle to provide additional shock absorption and to avoid additional over travel of door 102 when it is opened.

Figure 11:
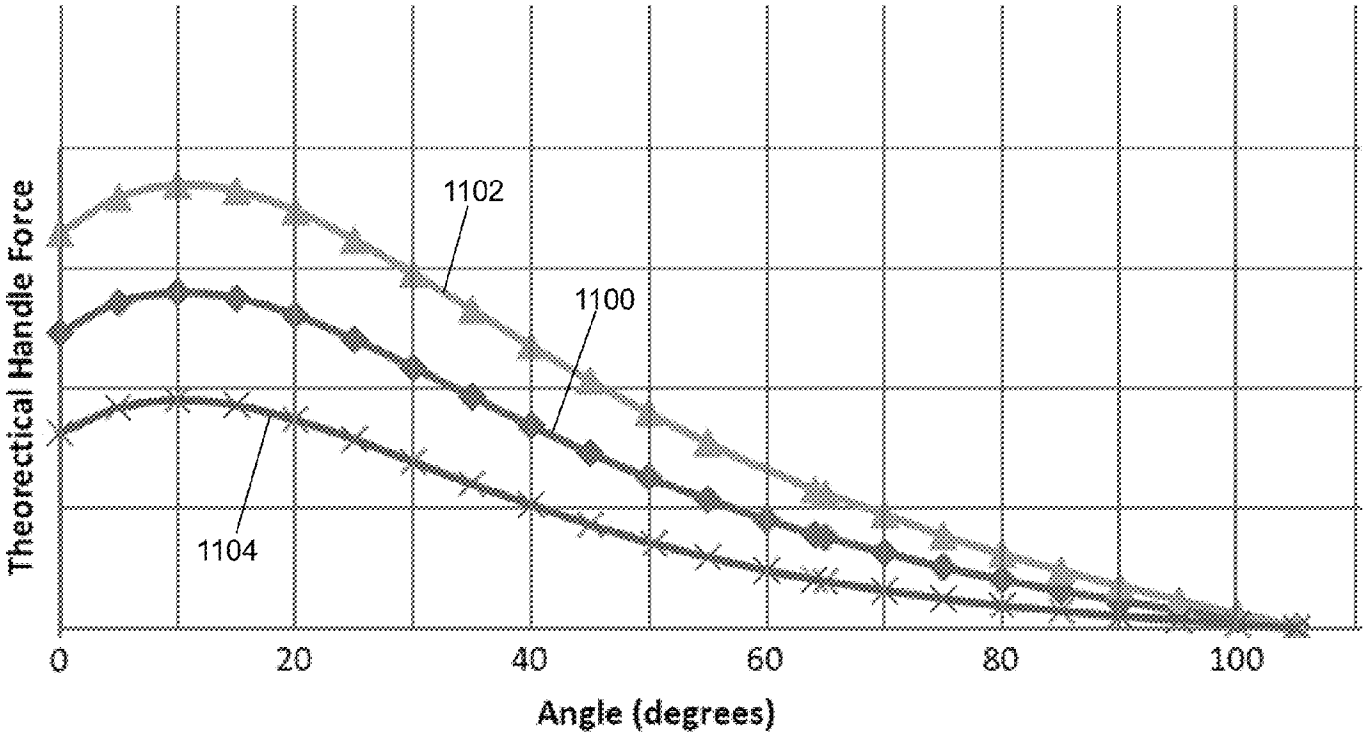
FIG. 11 shows a curve of a theoretical force created by the hinge of FIG. 1 as a function of the hinge opening angle in accordance with an illustrative embodiment.

With reference to FIG. 11, a first force curve 1100, a second force curve 1102, and a third force curve 1104 are shown which represent the force exerted on door 102 as a function of the opening angle in accordance with an illustrative embodiment. First force curve 1100 illustrates the change in force exerted on door 102 by closure device 246 as a function of the opening angle without a frictional force. Second force curve 1102 illustrates the change in force exerted on door 102 by closure device 246 as a function of the opening angle including frictional forces. Thus, in the illustrative embodiment, second force curve 1102 illustrates an opening force on door 102. Third force curve 1104 illustrates the change in force exerted on door 102 by closure device 246 as a function of the opening angle subtracting frictional forces. Thus, third force curve 1104 illustrates a closing force on door 102. The actual force values exerted on door 102 may be adjusted using adjustment rod 252 and/or adjustment nut 254 as discussed previously thereby shifting the force curves up or down. Additionally, tapered adjustment rod 252*a* can be used to adjust the application of frictional force thereby changing the slope of the force curves at selected opening angles. In the illustrative embodiment of FIG. 11, the force exerted on door 102 increases to a maximum at approximately 10 degrees opening angle and decreases from the maximum value to approximately zero at a maximum opening angle of 105 degrees. As a result, when door 102 is opened to the maximum opening angle an essentially neutral force is applied to door 102 so that the door 102 remains open. Of course, different maximum opening angles may be selected.

With continuing reference to the illustrative embodiment of FIG. 2, hinge 108 further includes a nut 256, a switch activation pin 258, and pin travel aperture 260. In an illustrative embodiment, nut 256 is a self-clinching nut such as a PEM nut® manufactured by Penn Engineering & Manufacturing Corp. Switch activation pin 258 is mounted to nut 256 and positioned to extend through pin travel aperture 260. Pin travel aperture 260 is an arc shaped aperture defined in top device bracket plate 214 and in bottom device bracket plate 216. Pin travel aperture 260 defines the direction of movement of closure device body 247 relative to top device bracket plate 214 and bottom device bracket plate 216 when door 102 is opened/closed.

Figure 12A:
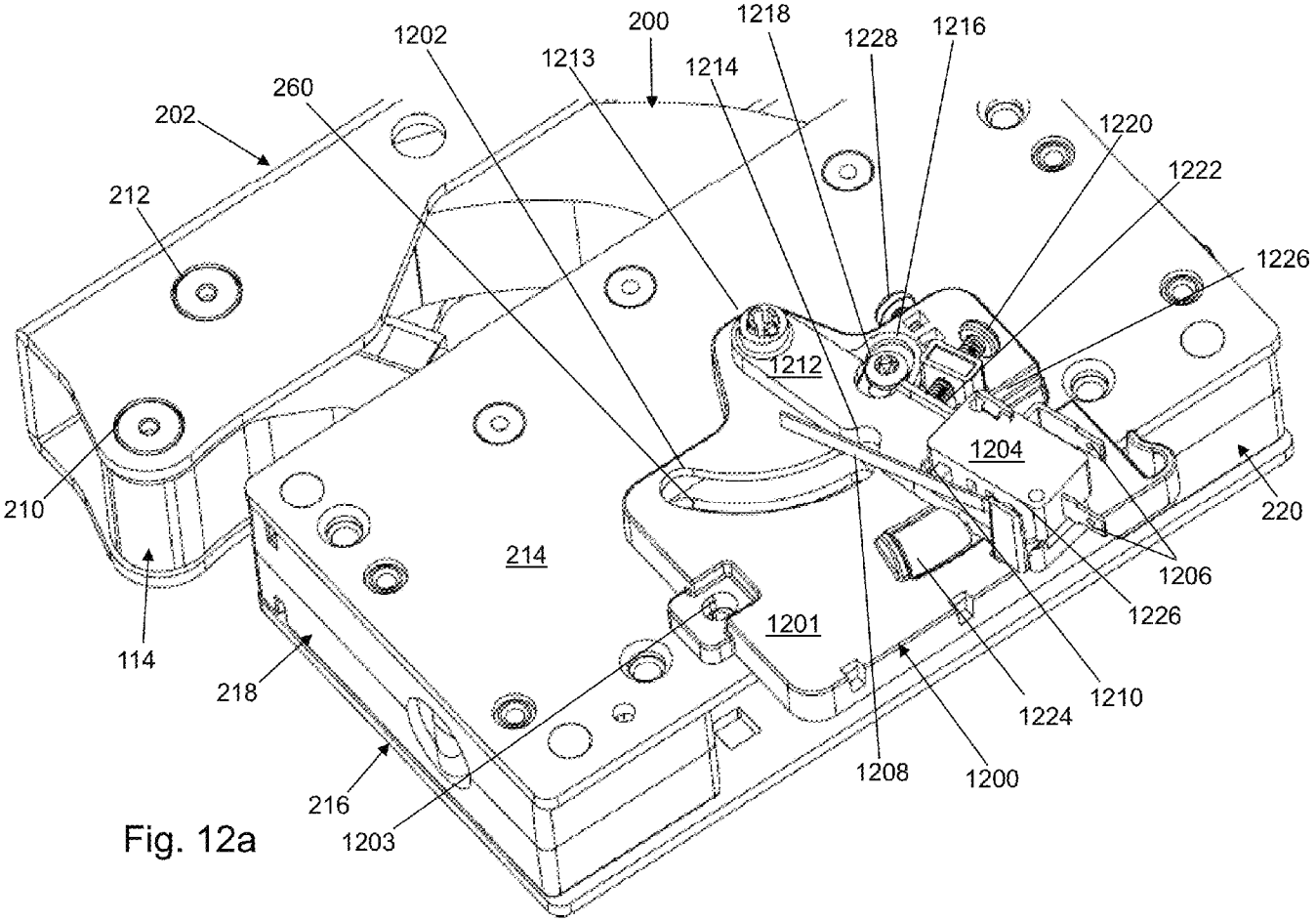
FIG. 12*a* depicts a top perspective view of the hinge of FIG. 1 in a closed position and including a switching system in accordance with an illustrative embodiment.
Figure 12B:
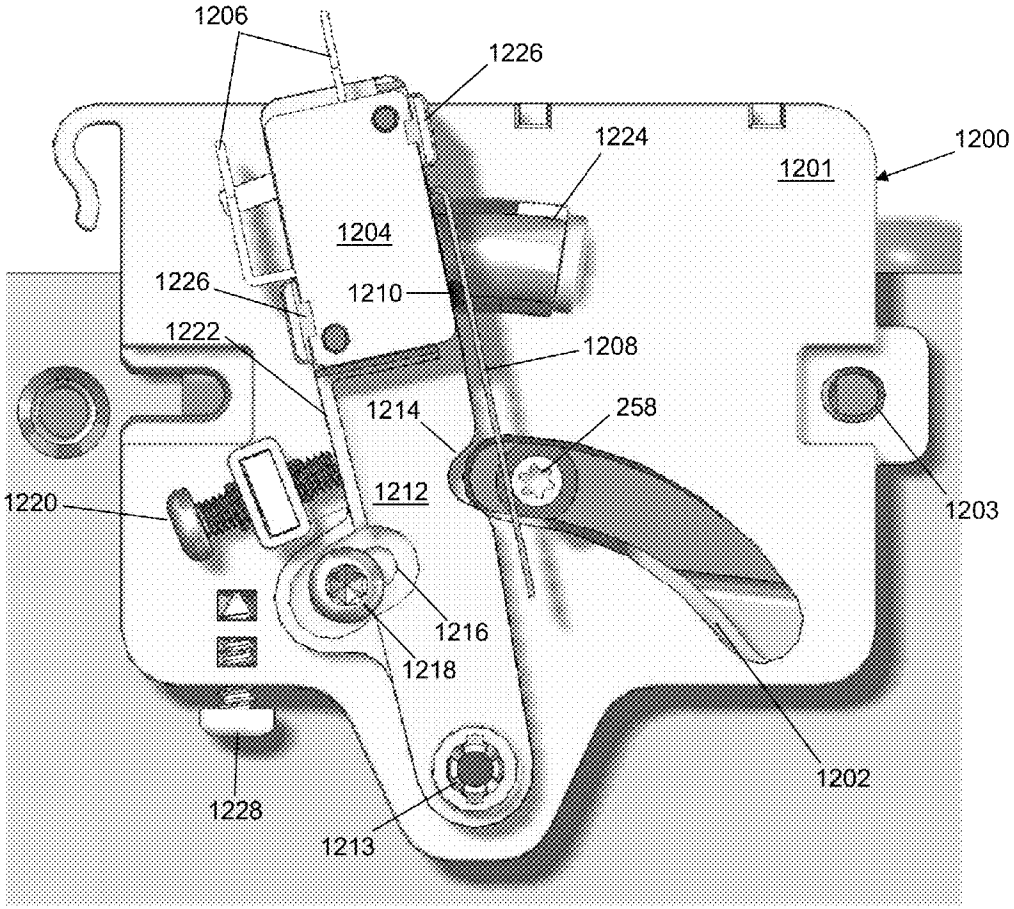
FIG. 12*b* depicts a top view of the switching system of FIG. 12*a* in accordance with an illustrative embodiment.

With reference to FIGS. 12*a* and 12*b*, a switching system 1200 is shown in accordance with an illustrative embodiment. Switching system 1200 is connected to control operation of a light, a fan, a water dispenser, etc. of device 100 based on a state of the switch as determined by the position of switch activation pin 258. Switching system 1200 may include switch activation pin 258, a switch base 1201, a switch pin aperture 1202, a mounting aperture 1203, a switch housing 1204, electrical connectors 1206, a switch lever arm 1208, a lever arm connector 1210, a switch mounting plate 1212, a mounting plate screw 1213, a pin abutment surface 1214, a positioning adjustment aperture 1216, a positioning adjustment screw 1218, a positioning screw 1220, a positioning screw abutment surface 1222, a biasing member 1224, switch locking tabs 1226, and a cover fastener 1228.

Switch housing 1204 houses the electrical components of switching system 1200. In an illustrative embodiment, switching system 1200 is an electromechanical device that determines the existence or not of an electrical contact between switch lever arm 1208 and lever arm connector 1210. Switching system 1200 can be in one of two states: "closed", which indicates that switch lever arm 1208 is touching lever arm connector 1210 such that electricity can flow between them; and "open", which indicates that switch lever arm 1208 is not touching lever arm connector 1210 such that the switch is non-conducting. In the illustrative embodiment, the "closed" state indicates door 102 is closed because switching system 1200 is positioned such that switch lever arm 1208 is touching lever arm connector 1210 when the door is closed (or alternatively, is not open to a sufficient angle to trigger a change in the switch state). The electrical connectors 1206 are connected to the one or more components of device 100 the operation of which may be controlled based on whether or not door 102 is open or is open more than a predefined angle. Thus, switching system 1200 may be mounted to indicate not just whether or not door 102 is open or not, but whether or not door 102 is open more than a predefined angle.

Switch housing 1204 is mounted to a switch holder. In the illustrative embodiment, the switch holder may include switch base 1201, switch mounting plate 1212, and switch locking tabs 1226. Switch base 1201 is mounted to top device bracket plate 214, for example, using a fastener inserted in mounting aperture 1203, and is thus accessible from exterior to hinge 108. Switch base 1201 may be mounted to top device bracket plate 214 using a plurality of fasteners. Switch mounting plate 1212 is mounted to switch base 1201, for example, using mounting plate screw 1213 inserted in a first aperture of switch mounting plate 1212 aligned with a second aperture of switch base 1201. Switch locking tabs 1226 mount switch housing 1204 to switch mounting plate 1212. Switch locking tabs 1226 are positioned at opposite corners of switch housing 1204. Cover fastener 1228 is used to mount a cover (not shown) over switching system 1200 to provide protection of the switching components.

In an illustrative embodiment, the position at which the switch of switching system 1200 is activated can be adjusted by moving switch housing 1204 relative to switch activation pin 258. An activation adjustment device may include positioning adjustment aperture 1216, positioning adjustment screw 1218, positioning screw 1220, positioning screw abutment surface 1222, biasing member 1224, and switch pin aperture 1202. Switch mounting plate 1212 is mounted to switch base 1201 using mounting plate screw 1213 positioned at one end of switch mounting plate 1212, which allows switch mounting plate 1212 to rotate about mounting plate screw 1213 when mounting plate screw 1213 is loose. Switch mounting plate 1212 is rotated to the desired activation position relative to switch activation pin 258. The desired activation position is selected based on the angle at which door 102 triggers the switch. For example, if an opening angle of one degree is selected to trigger the switch to change states, the door positioned at one degree defines the activation position of switch activation pin 258 within switch pin aperture 1202. At the activation position, switch activation pin 258 is no longer deflecting switch lever arm 1208 to contact lever arm connector 1210. To accommodate larger angles, switch activation pin 258 can be positioned adjacent pin abutment surface 1214 which is angled to allow protrusion of switch activation pin 258 beyond the plane of switch mounting plate 1212.

After positioning switch mounting plate 1212 with respect to switch activation pin 258 based on the desired activation angle of door 102, mounting plate screw 1213 is tightened and positioning adjustment screw 1218 is mounted within positioning adjustment aperture 1216 and tightened to hold switch mounting plate 1212 in place. Positioning adjustment aperture 1216 is sized and shaped to allow adjustment of a position of switch mounting plate 1212 relative to positioning adjustment screw 1218. Screw abutment surface 1222 is a surface of switch mounting plate 1212 opposite pin abutment surface 1214. Positioning screw 1220 also may be positioned to abut positioning screw abutment surface 1222 to further hold switch mounting plate 1212 in place. Biasing member 1224, which may be a spring, is positioned on the same side of switch mounting plate 1212 as pin abutment surface 1214 to provide a force opposite that exerted by positioning screw 1220 in abutting positioning screw abutment surface 1222 to further hold switch mounting plate 1212 in place. Therefore, the same hinge can be used to mount doors having different sizes while maintaining a predefined opening angle at which actions such as turning on or off lights is triggered.

Figure 13:
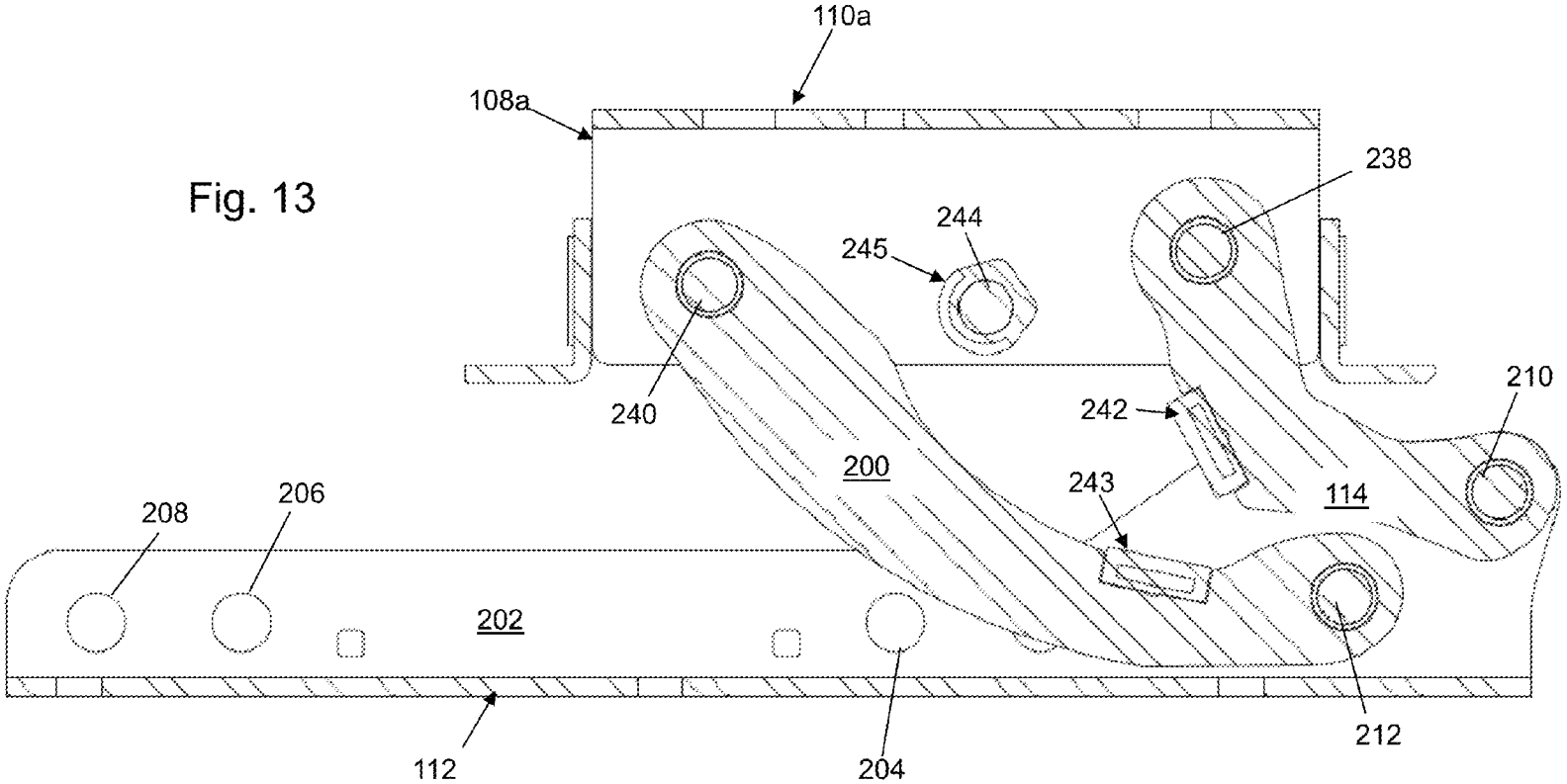
FIG. 13 depicts a top section view of a second hinge in a closed position in accordance with a second illustrative embodiment.

With reference to FIG. 13, a second hinge 108*a* is shown in accordance with a second illustrative embodiment. Second hinge 108*a* may include a second device bracket 110*a* , door bracket 112, first arm 114, and second arm 200. First arm 114 is mounted to second device bracket 110*a* and to door bracket 112. Second arm 200 is mounted to second device bracket 110*a* and to door bracket 112. Second hinge 108*a* is a kinematic hinge that has a similar structure to the 4-bar linkage portion of hinge 108. However, second hinge 108*a* does not include closure device 246 or switching system 1200. In an illustrative embodiment, second hinge 108 may be used in combination with hinge 108, but at a second mounting location.

Figure 14:
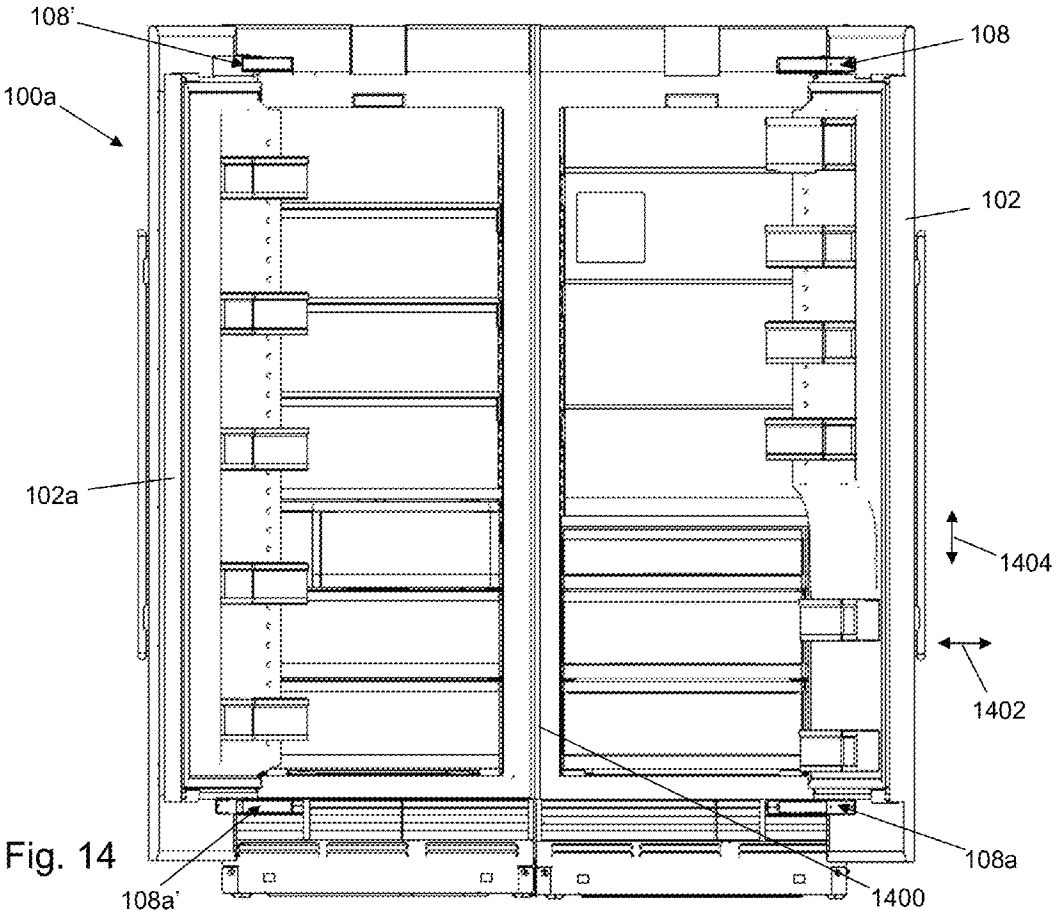
FIG. 14 depicts a perspective view of a device including a hinge in a plurality of locations on the device in accordance with an illustrative embodiment.

With reference to FIG. 14, a second device 100*a* is shown in accordance with an illustrative embodiment. Second device 100*a* may include door 102, a second door 102*a* , hinge 108, second hinge 108*a* , a third hinge 108', and a fourth hinge 108*a*'. Thus, second device 100*a* includes two doors with two hinges used to support each door. Merely for illustration, door 102 provides access to a refrigerated space and door 102*a* provides access to a freezer space. A compartment wall 1400 separates the refrigerated space from the freezer space and provides a contact surface for door 102 and second door 102*a* when the doors are closed.

Door 102 is pivotally mounted using hinge 108, which is mounted to a top of door 102, and using second hinge 108*a* , which is mounted to a bottom of door 102. Of course, hinge 108 can be mounted to a bottom of door 102 and second hinge 108*a* can be mounted to a top of door 102. Additionally, door 102 can be mounted to second device 100*a* using hinge 108 mounted to both the bottom and the top of door 102. Further, door 102 can be mounted to second device 100*a* using second hinge 108*a* mounted to both the bottom and the top of door 102.

Second door 102*a* is pivotally mounted using third hinge 108' mounted to a top of second door 102*a* and using fourth hinge 108*a*' mounted to a bottom of second door 102*a* . Third hinge 108' has a similar structure to hinge 108, and fourth hinge 108*a*' has a similar structure to second hinge 108*a* . Of course, third hinge 108' can be mounted to a bottom of second door 102*a* and fourth hinge 108*a*' can be mounted to a top of second door 102*a* . Additionally, second door 102*a* can be mounted to second device 100*a* using third hinge 108' mounted to both the bottom and the top of second door 102*a* . Further, second door 102*a* can be mounted to second device 100*a* using fourth hinge 108*a*' mounted to both the bottom and the top of Second door 102*a*.

Figure 15:
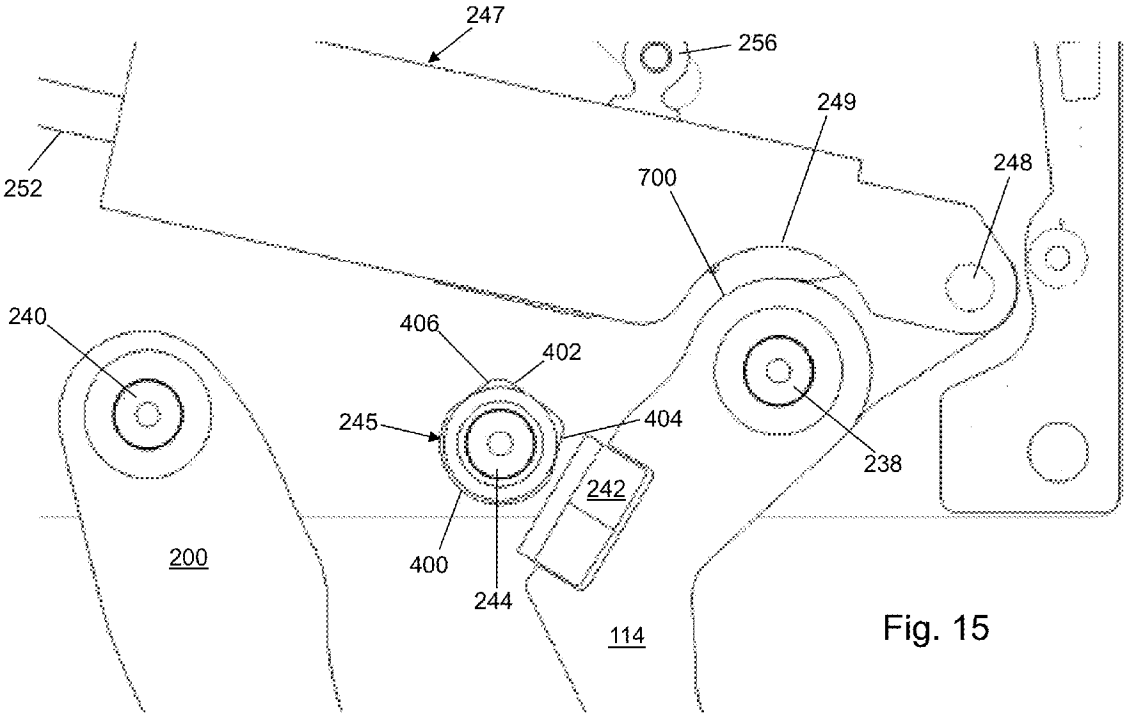
FIG. 15 depicts a top view of the hinge of FIG. 1 in a 90 degree open position in accordance with an illustrative embodiment without a top device bracket plate and zoomed to show a 90 degree stop feature.
Figure 16:
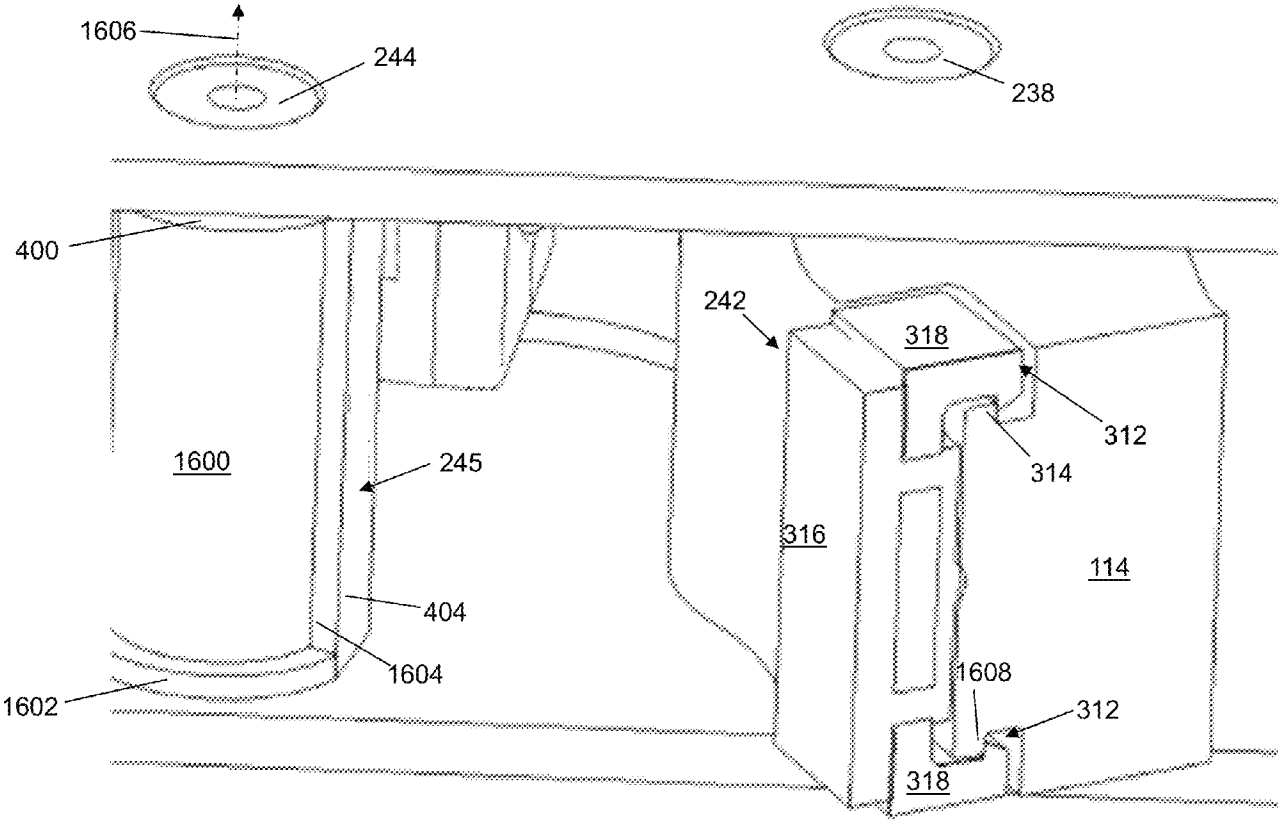
FIG. 16 depicts a side perspective view of the 90 degree stop feature of FIG. 15 in accordance with an illustrative embodiment.

With reference to FIG. 15, a top view of the hinge of FIG. 1 in a 90 degree open position is shown in accordance with an illustrative embodiment without a top device bracket plate and zoomed to show a 90 degree stop feature in more detail. As discussed previously, door stop pin housing 245 may include arced surface 400, stop surface 402, first connecting surface 404, and second connecting surface 406. With reference to FIG. 16, a side perspective view of the 90 degree stop feature of FIG. 15 is shown in accordance with an illustrative embodiment to show door stop pin housing 245 in more detail. In the illustrative embodiment, door stop pin housing 245 further includes an arced contact surface 1600, a second arced surface 1602, and a step surface 1604. Similar to arced surface 400, second arced surface 1602 has a curved shape. Arced contact surface 1600 extends between arced surface 400 and second arced surface 1602 and has a curved shape. Arced surface 400 and second arced surface 1602 have a first diameter measured relative to a center 1606 of door stop pin 244. A second diameter of arced contact surface 1600 measured relative to center 1606 of door stop pin 244 is less than the first diameter. Step surface 1604 is formed between arced contact surface 1600 and first connecting surface 404. As a result, first connecting surface 404, though flat instead of arced in shape, is a further distance, at its closest point, from center 1606 of door stop pin 244 than arced contact surface 1600. Though not shown, a second step surface similar to step surface 1604 is formed between arced contact surface 1600 and second connecting surface 406. Stop surface 402 is also a further distance, at its closest point, from center 1606 of door stop pin 244 than arced contact surface 1600. Door stop pin housing 245 can be rotated such that either of arced contact surface 1600, stop surface 402, first connecting surface 404, and second connecting surface 406 are contacted initially by first door stop 242. Because of the reduced diameter of arced contact surface 1600 relative to stop surface 402, first connecting surface 404, and second connecting surface 406, if door stop pin housing 245 is rotated such that arced contact surface 1600 contacts first door stop 242 first, door 102 can be opened to a greater angle than if door stop pin housing 245 is rotated such that either of stop surface 402, first connecting surface 404, and second connecting surface 406 contact first door stop 242 first. As a result, by rotation of door stop pin housing 245 the angle of opening of door 102 at which first door stop 242 contacts door stop pin housing 245 can be adjusted. Door stop pin housing 245 may be rotatable with respect to door stop pin 244 or door stop pin housing 245 may be fixedly mounted to door stop pin 244 and both door stop pin housing 245 and door stop pin 244 rotatable together to allow adjustment of the stop angle applied to door 102 by first door stop 242 contact with door stop pin housing 245. As a result, the stop angle applied to door 102 by first door stop 242 may be adjusted after assembly of hinge 108.

Figure 17:
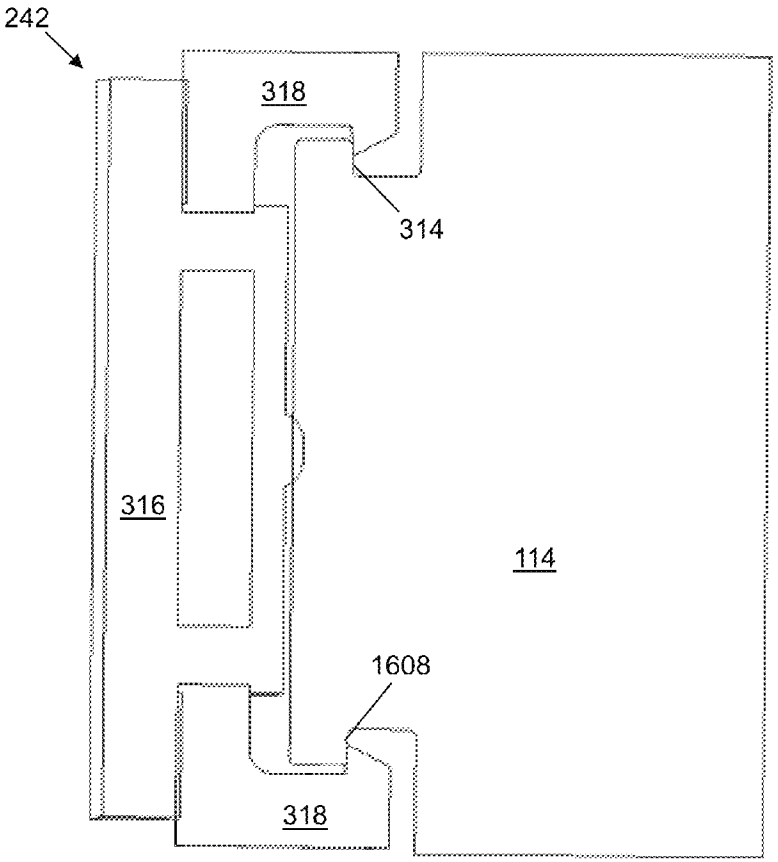
FIG. 17 depicts a side view of a door stop mounted to an arm in accordance with an illustrative embodiment.
Figure 19:
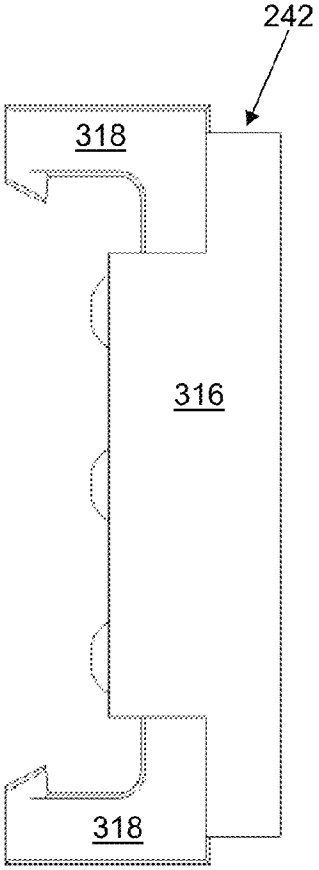
FIG. 19 depicts a side view of the door stop in accordance with an illustrative embodiment.
Figure 18:
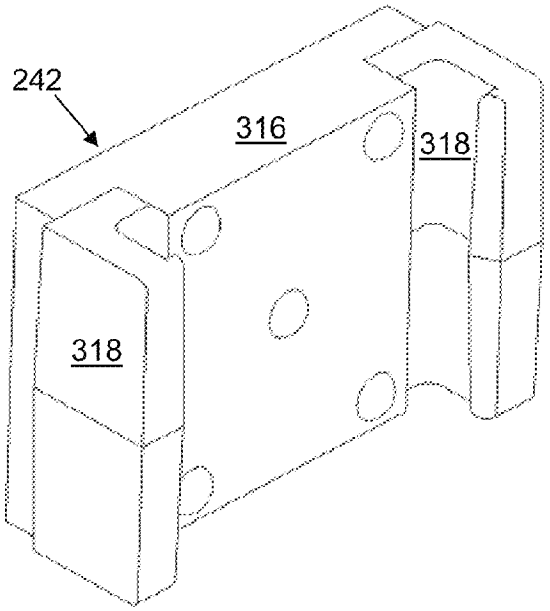
FIG. 18 depicts a perspective view of the door stop in accordance with an illustrative embodiment.

With reference to FIG. 17, a side view of first door stop 242 mounted to first arm 114 is shown in accordance with an illustrative embodiment. With reference to FIG. 18, a perspective view of first door stop 242 is shown in accordance with an illustrative embodiment. With reference to FIG. 19, a side view of first door stop 242 is shown in accordance with an illustrative embodiment. Second door stop 243 may be formed in a similar manner to that shown and described with reference to first door stop 242. As discussed previously and shown more clearly in FIGS. 16-17, first stop top ledge 314 and first stop bottom ledge 1608 are formed in first stop recess 312. As discussed previously and shown more clearly in FIGS. 16-19, first door stop 242 includes first shock absorber 316 and first stop snaps 318. First door stop 242 is mounted to first stop recess 312 by pressing first stop snaps 318 over first stop top ledge 314 and first stop bottom ledge 1608, and first shock absorber 316 is positioned outward to form a padded exterior surface on first arm 114.

The word "illustrative" is used herein to mean serving as an illustrative, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A switching system comprising:

a switch activation pin configured to mount to an arm that pivotally mounts a door to a body of a device, wherein the switch activation pin moves with the arm when the door is opened or closed;

a switch configured to mount to the device to control a component of the device; and a switch connector configured to mount to the device to activate the switch based on a position of the switch activation pin.

2. The switching system of claim 1, wherein the component of the device is selected from the group consisting of a light, a fan, and a water dispenser.

3. The switching system of claim 1, wherein the switch is an electrical switch.

4. The switching system of claim 3, wherein the switch connector comprises:

a connector; and a lever arm configured to mount to the device to contact the connector based on the position of the switch activation pin, wherein, when the lever arm contacts the connector, the switch is electrically activated.

5. The switching system of claim 1, further comprising a switch base configured to mount to the device, wherein the switch base includes a pin aperture through which the switch activation pin extends, the pin aperture sized and shaped to allow movement of the switch activation pin when the door is opened or closed.

6. The switching system of claim 5, wherein the switch connector comprises:

a connector; and a lever arm configured to mount to the device to contact the connector based on the position of the switch activation pin within the pin aperture.

7. The switching system of claim 5, further comprising an adjustment device configured to allow adjustment of a position at which the switch is activated by the switch activation pin.

8. The switching system of claim 7, wherein the switch connector comprises:

a connector; and a lever arm configured to mount to the device to contact the connector based on the position of the switch activation pin within the pin aperture.

9. The switching system of claim 8, wherein the adjustment device comprises:

an adjustment plate mounted to the switch base to allow pivotal positioning of the adjustment plate relative to the lever arm, wherein the connector is mounted to the adjustment plate and the lever arm is mounted to the switch base.

10. The switching system of claim 9, wherein the switch is mounted to the adjustment plate.

11. The switching system of claim 9, wherein a position at which the switch is activated is adjusted by moving the adjustment plate relative to the switch activation pin and to the lever arm.

12. The switching system of claim 9, wherein the adjustment device further comprises an adjustment screw positioned to abut a side wall of the adjustment plate.

13. The switching system of claim 12, wherein the adjustment device further comprises a biasing member positioned to abut a second side wall of the adjustment plate to bias the adjustment plate toward the adjustment screw.

14. The switching system of claim 9, wherein the adjustment plate further comprises a protrusion formed in a side wall of the adjustment plate, wherein the protrusion is positioned adjacent the pin aperture and sized and shaped to accommodate the switch activation pin.

15. The switching system of claim 9, wherein the adjustment plate further comprises:

a positioning adjustment aperture formed through a surface of the adjustment plate; and a fastener mounted through the positioning adjustment aperture to mount the adjustment plate to the switch base.

16. A hinge comprising:

a device bracket configured for mounting to a device surface of a device;

a door bracket configured for mounting to a door surface of a door of the device;

an arm mounted for rotation about a first pin and about a second pin, wherein the first pin is mounted to the device bracket and the second pin is mounted to the door bracket;

a switch activation pin configured to mount to the arm to move with the arm when the door is opened or closed;

a switch configured to mount to the device to control a component of the device; and a switch connector configured to mount to the device to activate the switch based on a position of the switch activation pin.

17. The hinge of claim 16, further comprising a closure device body, wherein the device bracket comprises a side wall that extends in a direction of the first pin, and the closure device body mounts to the arm at a first end and to the side wall at a second end, wherein the switch activation pin is mounted to the closure device body.

18. The hinge of claim 17, further comprising a switch base mounted to a plate of the device bracket, wherein the switch base includes a first pin aperture through which the switch activation pin extends, wherein the plate includes a second pin aperture aligned with the first pin aperture through which the switch activation pin extends, wherein the first pin aperture and the second pin aperture are sized and shaped to allow movement of the switch activation pin when the door is opened or closed.

19. The hinge of claim 18, wherein the switch activation pin is mounted to extend in a direction perpendicular to the device surface of the device.

20. A refrigerator comprising:

a body;

a door;

a hinge pivotally mounting the door to the body, the hinge comprising a refrigerator bracket mounted to a surface of the body;

a door bracket mounted to a door surface of the door; and an arm mounted for rotation about a first pin and about a second pin, wherein the first pin is mounted to the refrigerator bracket and the second pin is mounted to the door bracket;

a switch activation pin mounted to the arm to move with the arm when the door is opened or closed;

a switch mounted to the body to control a component of the refrigerator; and a switch connector mounted to the body to activate the switch based on a position of the switch activation pin.

* * * * *